US007043789B2

(12) United States Patent
Morrish

(10) Patent No.: US 7,043,789 B2
(45) Date of Patent: May 16, 2006

(54) FOLDABLE RAMP AND METHOD FOR ITS MANUFACTURE

(75) Inventor: Gerald David Morrish, Potters Bar (GB)

(73) Assignee: Enable Access, Herts (GB)

( * ) Notice: Subject to any disclaimer, the term of this patent is extended or adjusted under 35 U.S.C. 154(b) by 0 days.

(21) Appl. No.: 10/833,188

(22) Filed: Apr. 28, 2004

(65) Prior Publication Data

US 2005/0241083 A1 Nov. 3, 2005

(51) Int. Cl.
*E01D 1/00* (2006.01)

(52) U.S. Cl. ..... 14/69.5; 414/537; D34/32

(58) Field of Classification Search ..... 14/69.5, 14/71.1, 72.5; 414/537; D34/32; 52/282.2, 52/70, 71

See application file for complete search history.

(56) References Cited

U.S. PATENT DOCUMENTS

| | | | | | |
|---|---|---|---|---|---|
| 2,827,016 | A | * | 3/1958 | Jenkins | 119/849 |
| 3,352,440 | A | * | 11/1967 | Wilson | 414/537 |
| 3,517,791 | A | * | 6/1970 | Miles | 193/41 |
| 3,756,440 | A | * | 9/1973 | Raap et al. | 414/537 |
| 4,039,163 | A | * | 8/1977 | Shorey | 244/137.1 |
| D246,449 | S | * | 11/1977 | Poe | D34/32 |
| 4,557,091 | A | * | 12/1985 | Auer | 52/282.3 |
| 4,726,155 | A | * | 2/1988 | Nahmias | 52/71 |
| D297,064 | S | * | 8/1988 | Ball et al. | D34/32 |
| D299,776 | S | * | 2/1989 | Canterberry | D34/32 |
| 5,273,335 | A | * | 12/1993 | Belnap et al. | 296/61 |
| 5,339,576 | A | * | 8/1994 | Fussler | 52/71 |
| 5,486,391 | A | * | 1/1996 | Tyner | 428/44 |
| 5,933,898 | A | * | 8/1999 | Estes et al. | 14/69.5 |
| 6,009,587 | A | * | 1/2000 | Beeman | 14/69.5 |
| 6,119,634 | A | * | 9/2000 | Myrick | 119/847 |
| 6,389,629 | B1 | * | 5/2002 | Schouest | 14/69.5 |
| 6,430,769 | B1 | * | 8/2002 | Allen | 14/69.5 |
| 6,859,980 | B1 | * | 3/2005 | Baer | 16/354 |
| 2002/0078513 | A1 | * | 6/2002 | Schouest | 14/69.5 |
| 2003/0056907 | A1 | * | 3/2003 | Caveney et al. | 160/135 |

FOREIGN PATENT DOCUMENTS

| | | |
|---|---|---|
| GB | 3009252 | 1/2003 |

* cited by examiner

*Primary Examiner*—Thomas B. Will
*Assistant Examiner*—Alexandra Pechhold
(74) *Attorney, Agent, or Firm*—Buchanan Ingersoll PC

(57) ABSTRACT

A foldable ramp, typically a portable foldable ramp for use in allowing access to wheelchairs up and down steps and/or into and out of vehicles. The ramp has two track members that each have a channel formed along their elongate sides that face each other when the ramp is unfolded. A series of first hinge elements is retained in one channel and a series of second hinge elements retained in a second channel. Each element of the series of first hinge elements is arranged to cooperate with at least one element of the second series, so that the first and second hinge elements are arranged alternately in the ramp to provide a hinge connection between the elongate sides of the first and second track members.

11 Claims, 4 Drawing Sheets

FOLDABLE RAMP AND METHOD FOR ITS MANUFACTURE

FIELD OF THE INVENTION

The present invention relates to a foldable ramp and a method for manufacturing a foldable ramp. Such ramps are of particular, but not exclusive, use in enabling wheelchair users to move a wheelchair up a step or steps or into or out of a vehicle. Such ramps may be portable, for example.

BACKGROUND TO THE INVENTION

Known wheelchair ramps include ramps consisting of two tracks that are connected along an elongate side by one or more hinges. The hinge allows the tracks to be folded together into a storage or transport configuration. For use, the tracks are moved apart by 180° so that they are unfolded to a flat configuration. The ramp is positioned to provide an inclined surface where required, for example up a step or series of steps, or from a vehicle such as a car, train, bus or coach.

The present inventor has realised that known ramps of this type are difficult to manufacture. In particular, the connection of the two tracks using the hinge is a difficult and time consuming task.

SUMMARY OF THE INVENTION

Accordingly, an object of the present invention is to provide a ramp that is straightforward to manufacture.

In a first aspect, the present invention provides a foldable ramp having:

- a first track member;
- a first channel formed along an elongate side of said first track member;
- a series of first hinge elements retained in said first channel;
- a second track member;
- a second channel formed along an elongate side of said second track member; and
- a series of second hinge elements retained in said second channel, wherein each element of the series of first hinge elements is arranged to cooperate with at least one element of the second series, so that the first and second hinge elements are arranged alternately in the ramp to provide a hinge connection between said elongate sides of the first and second track members.

Preferably, the series of first hinge elements and the series of second hinge elements are arranged to cooperate interdigitatingly in the ramp.

Preferably, the first hinge elements have a protrusion portion for a rotational mating engagement with a correspondingly shaped recess in the second hinge elements.

Preferably, the second hinge elements have a protrusion portion for a rotational mating engagement with a correspondingly shaped recess in the first hinge elements.

Preferably, each first hinge element is rotationally engaged with one second hinge element to one side and with another second hinge element to the other side, along the axis of hinging of the ramp.

Preferably, each second hinge element is rotationally engaged with one first hinge element to one side and with another first hinge element to the other side, along the axis of hinging of the ramp.

The protrusion portions and the recesses are typically of generally cylindrical shape, the principal axis of said shapes being coaxial with the axis of hinging of the ramp, when assembled.

Preferably, each hinge element has an anchor portion for engagement with the channel of its respective track member. Typically, the anchor portion is shaped to be slidable along the channel during manufacture of the ramp. The channel may be of a general 'T' shape, for example. Each respective channel preferably extends in the elongate direction of its respective track member.

Preferably, the respective channels extend substantially full length along said elongate sides of the track members. Furthermore, the hinge assembled from the first and second hinge elements preferably extends substantially the full length of the ramp.

The total number of first and second hinge elements required depends on the lengths of the individual hinge elements and the elongate length of the ramp. Typically, there are at least 10 of each of the first and second hinge elements. There may be more, for example at least 20 or at least 30 of each.

Typically, the hinge elements are retained in their respective channels by retaining means. Preferably, the retaining means is a portion of an end lip of the track at the respective end of the track.

Typically, each track member includes a panel, such as a honeycomb panel. Aluminium honeycomb panels, for example, can be sufficiently strong in service and yet are of low weight, making the ramp highly portable. The channel for retaining the hinge elements may be provided by a hinge retaining member attached to the panel. The hinge retaining member may be formed, for example, by extrusion.

The ramp may have kerb members that serve to prevent a wheelchair from rolling off a side of the ramp when in use. One such kerb member may be provided at each lateral side of the ramp when unfolded in use. The kerb members may be located at the elongate side of the tracks away from the hinge. Each kerb member typically includes an upstanding portion. However, when a ramp is folded, it is the kerb members that limit the compactness of the folded ramp, because it is normally the kerb members that meet to prevent the track members from being folded completely flat against each other.

In order to address this problem, the hinge of preferred embodiments of the present invention is of asymmetric configuration. Thus, the axis of hinging allows only asymmetric folding of the ramp. The axis of hinging may be located, for example, closer to one of the track members than to the other. The result of this is that, when the ramp is folded, the kerb members overlap so that the ramp can be folded to a fuller extent than if the kerb members met head-on.

The asymmetric hinge configuration allows the track members and the kerb members of both sides of the ramp to be formed from identical components. This can reduce the complexity of manufacturing the ramp.

In the first aspect of the invention, the first and second hinge members may have a different shape in order to provide an asymmetric hinge. For example, the distance between the anchor portion of the first hinge element and the protrusion portion or recess portion of the first hinge element may be different to the distance between the anchor portion of the second hinge element and the protrusion portion or recess portion of the second hinge element. In this way, the hinge axis may be disposed closer to the anchor portions of the first hinge elements than to the anchor portions of the second hinge elements or vice versa. Similarly, the hinge axis may be disposed closer to the first track member than to the second track member or vice versa.

In a second aspect, the present invention provides a method of manufacturing a foldable ramp, including providing:

a first track member;
a first channel formed along an elongate side of said first track member;
a series of first hinge elements;
a second track member;
a second channel formed along an elongate side of said second track member; and
a series of second hinge elements, the method further including the steps of sliding the first and second hinge elements into position along said respective channels so that each element of the series of first hinge elements is arranged to cooperate with at least one element of the second series and so that the first and second hinge elements are arranged alternately in the ramp to provide a hinge connection between said elongate sides of the first and second track members.

Preferred features of the second aspect include those preferred and/or optional features set out with respect to the first aspect.

BRIEF DESCRIPTION OF THE DRAWINGS

A preferred embodiment of the invention is set out below in detail, with reference to the accompanying drawings, in which.

DETAILED DESCRIPTION OF THE PREFERRED EMBODIMENT

The following detailed description is made by way of example. On reading this disclosure, modifications of the embodiment that fall within the scope of the invention will be apparent.

Figure 1:
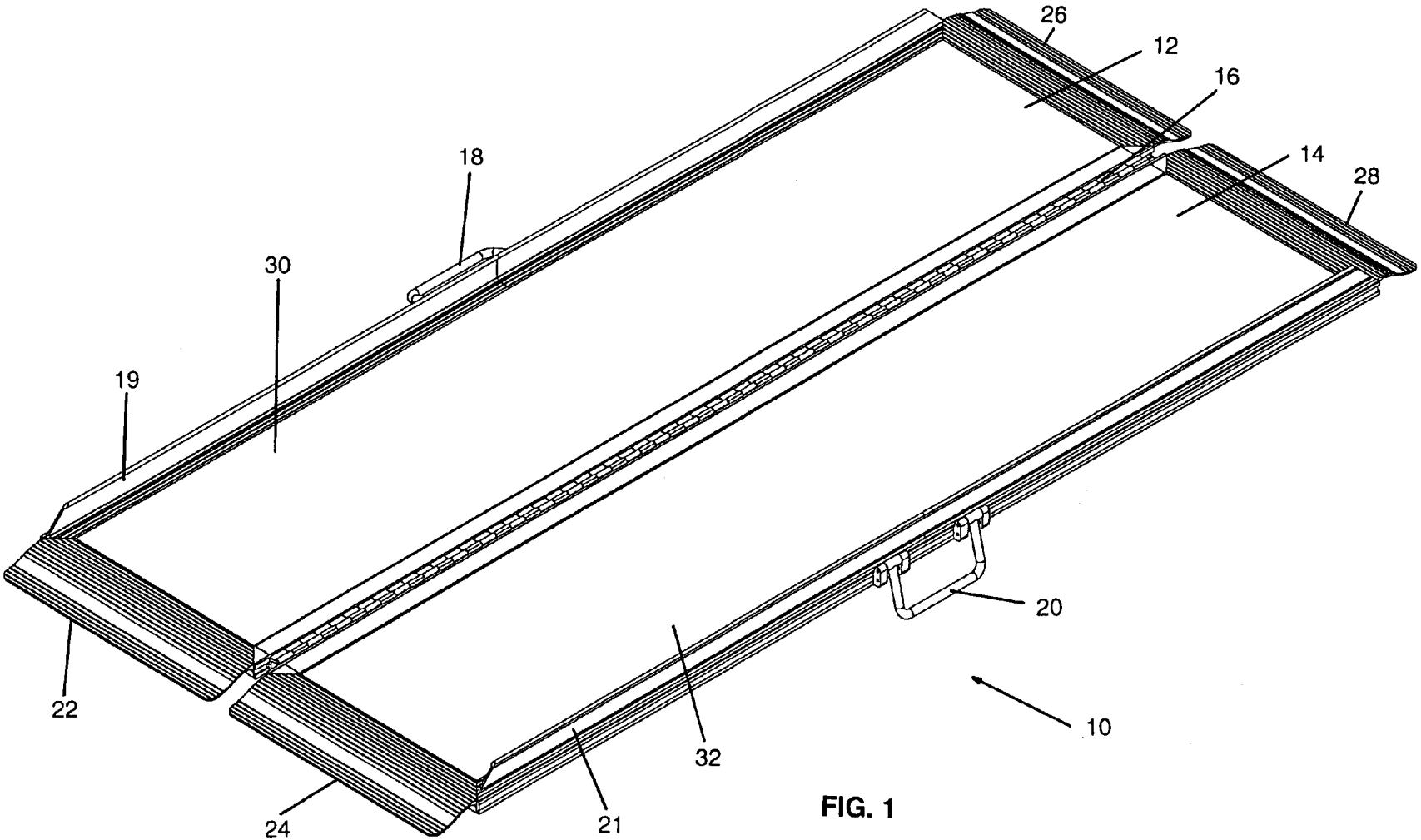
FIG. 1 shows a perspective view of a foldable ramp according to an embodiment of the invention in the unfolded configuration.
Figure 2:
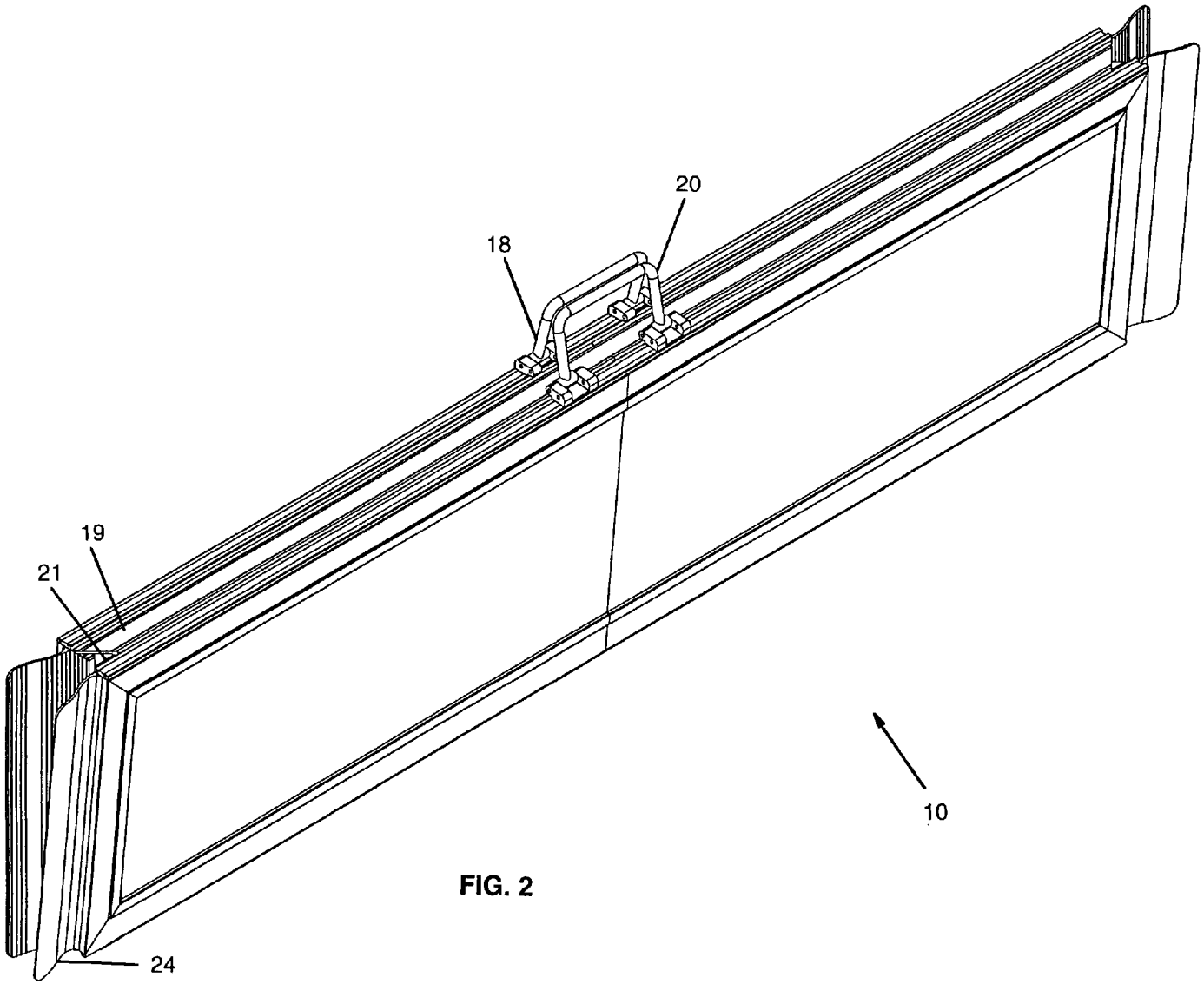
FIG. 2 shows a perspective view of the foldable ramp of FIG. 1 in the folded configuration.

FIGS. 1 and 2 show a folding ramp 10 according to an embodiment of the invention. In FIG. 1, the ramp is in the unfolded configuration whereas in FIG. 2, the ramp is in the folded configuration.

In FIGS. 1 and 2, the ramp has two track members 12, 14 joined along an elongate side by a hinge 16. At the other elongate side of each track member is a handle 18, 20. At each end of each track member is a lip 22, 24, 26, 28 for assisting in wheelchair entry and exit from the ramp.

Each track member is formed around an aluminium honeycomb panel 30, 32 of known construction. The lips 22, 24, 26, 28 and kerb members 19, 21 are formed from aluminium by extrusion in a known manner. These parts of the ramp attach to their respective panel by an interference fit.

The attachment of the hinge 16 to the panels 30, 32 will now be described in more detail, with reference to FIGS. 3 to 8.

Figure 3:
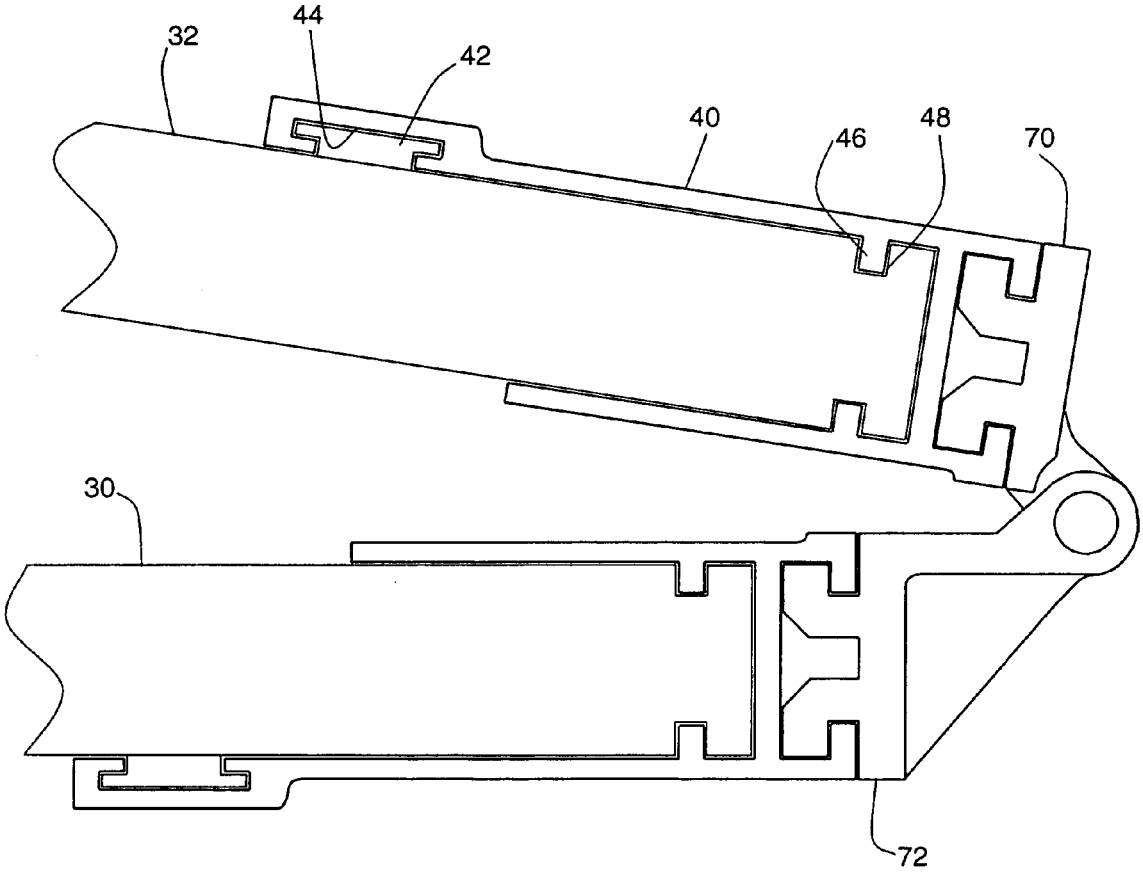
FIG. 3 shows a partial schematic cross-sectional view of the hinged part of the ramp of FIG. 2.

Looking first at FIG. 3, a generally 'U'-shaped hinge retaining member 40 embraces and is attached to an elongate side of panel 32 by an interference fit. Hinge retaining member 40 is formed from aluminium by extrusion and is described in more detail below with reference to FIG. 4. An upstanding 'T'-shaped elongate protrusion 42 connected to the panel is captured in corresponding slot 44 in the hinge retaining member. Furthermore, elongate ridges 46 protruding inwardly from the hinge retaining member engage with correspondingly-shaped grooves 48 in the panel.

Figure 4:
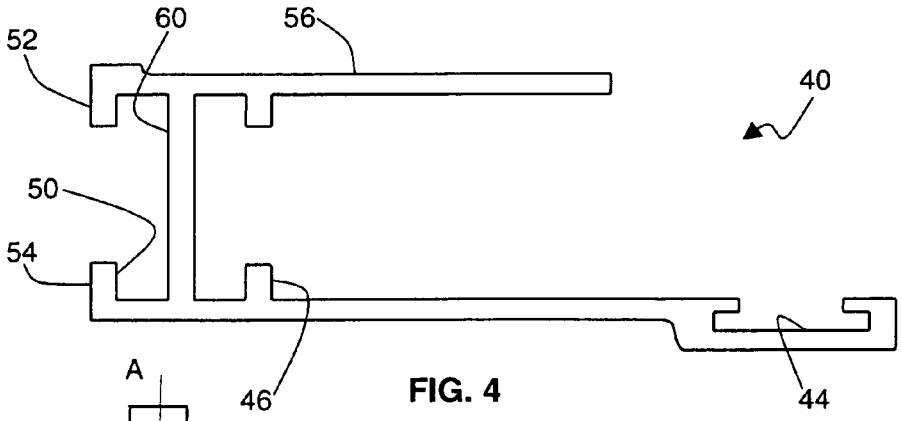
FIG. 4 shows a schematic cross-sectional view of a hinge retaining member for use with an embodiment of the invention.
Figure 5:
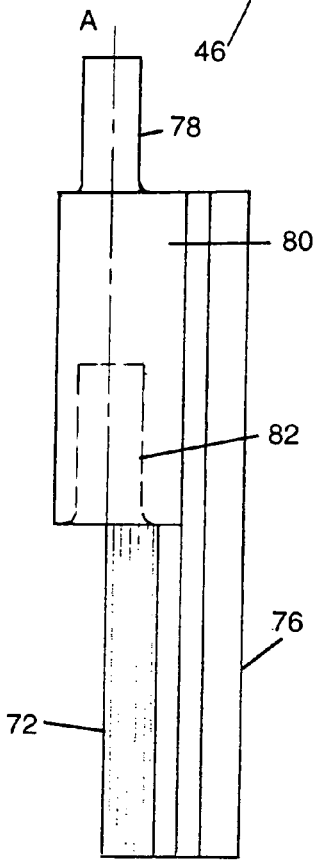
FIG. 5 shows a side view of a first hinge element for use with an embodiment of the invention.
Figure 6:
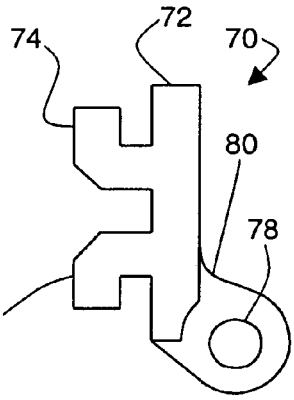
FIG. 6 shows a top view down the hinging axis of the hinge element of FIG. 5.
Figure 7:
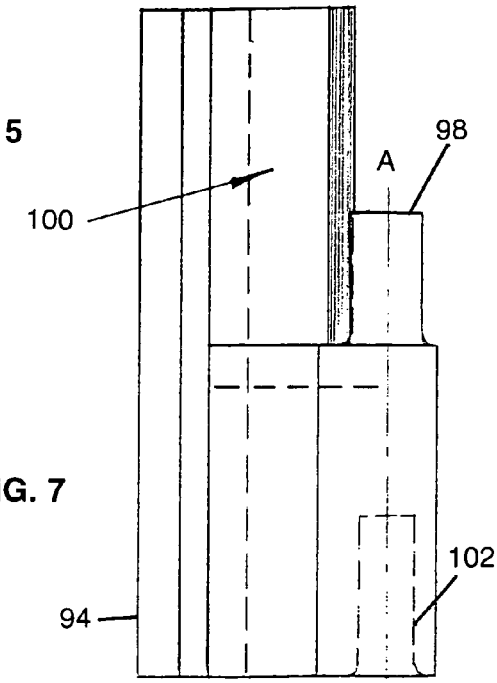
FIG. 7 shows a side view of a second hinge element for use with an embodiment of the invention.

FIG. 4 shows a cross-sectional view of the hinge retaining member 40 in clearer detail. At the side of the member distal to the slot 44 is an elongate channel 50 of generally 'T'-shaped cross section and defined by overhanging arms 52, 54 extending from top plate 56 and bottom plate 58 of the hinge retaining member, respectively. The top and bottom plates are spaced apart by spacer 60, which also serves to define the depth of channel 50.

Figure 8:
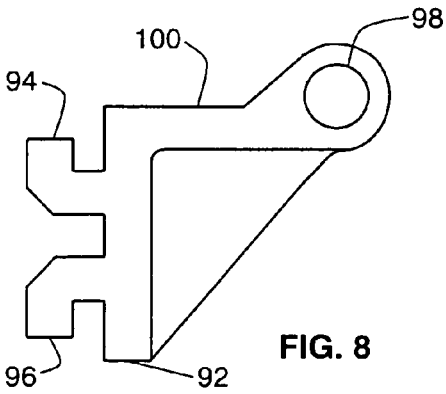
FIG. 8 shows a top view down the hinging axis of the hinge element of FIG. 7.

Channel 50 is shaped to slidingly accommodate first hinge elements 70 (FIGS. 5 and 6) or second hinge elements 100 (FIGS. 8 and 9). The hinge elements are typically formed of nylon plastics material.

First hinge elements 70 have a body portion 72 from which extend slightly flexible dog leg portions 74, 76, which together have an overall general 'T'-shaped cross section. The dog leg portions are capable of being slid along and retained in channel 50 of the hinge retaining member 40. An angled portion 80 extends from the body portion and supports a cylindrical protrusion 78 coaxial with the hinging axis A of the first hinge elements when located in the ramp. At the opposite side (along the hinging axis A) of the angled portion 80 is a cylindrical recess 82 that is also coaxial with the hinging axis A.

Dog legs 94, 96 of the second hinge elements 90 are of generally similar construction to those of the first hinge elements. The body portion 92 has a longer angled portion 100 extending from it, supporting a cylindrical protrusion 98 that is coaxial with the hinging axis A of the second hinge elements when located in the ramp. The cylindrical protrusion 98 is sized and shaped to rotationally fit into cylindrical recess 82 of the first hinge element. The angled portion 100 also has a cylindrical recess 102 at the opposite side (along the hinging axis A) of the angled portion 100 that is also coaxial with the hinging axis A. Cylindrical recess 102 is sized and shaped to allow the cylindrical protrusion 78 of the first hinge element to rotationally fit into it.

FIG. 3 shows, in cross-section, how the hinge elements fit into the hinge retaining members and also how the first and second hinge elements fit with each other. In order to manufacture the hinge of the ramp according to the embodiment, the hinge retaining elements are first fitted to the panels 30, 32. The panels are then located next to each other, the same distance apart as in the finished ramp. A first hinge element is inserted into channel 50 of one of the hinge retaining members and slidably located at one end of that hinge retaining member. A second hinge element is then inserted into channel 50 of the other hinge retaining member and slidably located into position so that cylindrical protrusion 98 fits into cylindrical recess 82 of the first hinge element already located in position in the ramp. Subsequently, a further first hinge element is inserted into the channel of its respective hinge retaining member and its cylindrical protrusion 78 is caused to fit into cylindrical recess 102 of the second hinge element. This process is repeated until a hinge 16 that runs substantially the full length of the track members 12, 14 has been built up. The resultant hinge has alternating first and second hinge elements that engage with each other. In effect, the first track member has a series of first hinge elements and the second track member has a series of second hinge elements, the series interdigitating with each other.

The hinge elements are prevented from sliding out of their respective channels by lateral side portions of lip members 22, 24, 26, 28. The lip elements are fitted to the ramp after the formation of the hinge, thereby capturing the hinge within the ramp.

It is to be noted from FIG. 3 that the first and second hinge elements have different shapes. The effect of this is that the hinge axis is located closer to panel 32 than to panel 30. At the other longitudinal side of each panel is a kerb member 19, 21. The effect of the asymmetrical shape of the hinge is that when the ramp is folded, the kerb members 19, 21 overlap each other (as shown in FIG. 2) instead of abutting each other. Thus, the folded ramp has a slimmer configuration than would otherwise be the case.

The above embodiment has been described by way of example. Modifications of this embodiment, further embodiments and modifications thereof will be apparent to skilled persons on reading this disclosure and as such are within the spirit and scope of the invention.

The invention claimed is:

1. A foldable ramp having:

a first track member;

a first T-shaped elongate channel formed along an elongate side of said first track member;

a series of first hinge elements slidably located and retained in said first T-shaped elongate channel;

a second track member;

a second T-shaped elongate channel formed along an elongate side of said second track member; and a series of second hinge elements slidably located and retained in said second T-shaped elongate channel, wherein each element of the series of first hinge elements is arranged to cooperate with at least one element of the second series, so that the first and second hinge elements are arranged alternately in the ramp to provide a hinge connection between said elongate sides of the first and second track members; and wherein the first hinge elements have a respective protrusion portion for rotational mating engagement with respective correspondingly shaped recesses in the second hinge elements, said protrusion portions and recesses being arranged along a hinging axis of the ramp.

2. A foldable ramp according to claim 1 wherein the series of first hinge elements and the series of second hinge elements are arranged to cooperate interdigitatingly in the ramp.

3. A foldable ramp according to claim 1 wherein the second hinge elements have a protrusion portion for a rotational mating engagement with a correspondingly shaped recess in the first hinge elements.

4. A foldable ramp according to claim 1 wherein each hinge element has an anchor portion for engagement with the T-shaped elongate channel of its respective track member.

5. A foldable ramp according to claim 4 wherein the hinge assembled from the first and second hinge elements extends substantially the full length of the ramp.

6. A foldable ramp according to claim 1 wherein a hinge axis of the ramp is located closer to the first track member than to the second track member so that the ramp is foldable asymmetrically.

7. A foldable ramp according to claim 6 wherein each track member has a kerb member located at an elongate side distal from the hinge, the asymmetric folding of the ramp causing the kerb members to overlap when the ramp is folded.

8. A foldable ramp according to claim 1 wherein the protrusion portions and the recesses extend longitudinally along the hinging axis.

9. A foldable ramp according to claim 1 wherein the protrusion portions are cylindrical and fit within the recesses so as to enable the recesses of the second hinge elements to pivot about respective protrusion portions of the first hinge elements.

10. A foldable ramp having:

a first track member;

a first T-shaped elongate channel formed along an elongate side of said first track member;

a series of first hinge elements slidably located and retained in said first channel;

a second track member;

a second T-shaped elongate channel formed along an elongate side of said second track member; and a series of second hinge elements slidably located and retained in said second channel, wherein each hinge element has an anchor portion for sliding location along its respective T-shaped elongate channel during manufacture of the ramp, and wherein each element of the series of first hinge elements has a respective protrusion portion for rotational mating engagement with respective correspondingly shaped recesses in the second hinge elements, and each element of the series of second hinge elements has a protrusion portion for rotational mating engagement with respective correspondingly shaped recesses in the first hinge elements, said protrusion portions and recesses being arranged along a hinging axis of the ramp, so that the first and second hinge elements are arranged alternately in the ramp to provide a hinge connection between said elongate sides of the first and second track members.

11. A method of manufacturing a foldable ramp, including providing:

a first track member;

a first channel formed along an elongate side of said first track member;

a series of first hinge elements;

a second track member;

a second channel formed along an elongate side of said second track member; and a series of second hinge elements, wherein the first hinge elements each have a respective protrusion portion for rotational mating engagement with respective correspondingly shaped recesses in the second hinge elements, the method further including the steps of sliding the first and second hinge elements into position along said respective channels so that each element of the series of first hinge elements is arranged to cooperate with at least one element of the second series and so that the first and second hinge elements are arranged alternately in the ramp to provide a hinge connection between said elongate sides of the first and second track members, said protrusion portions and recesses being arranged along a hinging axis of the ramp.

* * * * *